US005524877A

United States Patent [19]

Weber et al.

[11] Patent Number: 5,524,877

[45] Date of Patent: Jun. 11, 1996

[54] DEVICE FOR DEPOSITING AND/OR STACKING SHEET-LIKE RECORDING SUBSTRATES

[75] Inventors: Bruno Weber, Hettenshausen, Germany; Thomas Rutishauser, Uerikon, Switzerland

[73] Assignee: Rutishauser GmbH, Pfaffenhofen, Germany

[21] Appl. No.: 360,437

[22] Filed: Dec. 21, 1994

[30] Foreign Application Priority Data

Dec. 23, 1993 [CH] Switzerland ..... 3858/93

[51] Int. Cl.[6] ..... B65H 31/26

[52] U.S. Cl. ..... 271/220; 271/196

[58] Field of Search ..... 271/81, 196, 189, 271/200, 201, 213, 214, 215, 217, 220, 223, 306, 265

[56] References Cited

U.S. PATENT DOCUMENTS 1,305,501 6/1919 Steele ..... 271/201 X 3,331,516 7/1967 Gubeli ..... 271/201 X 4,279,555 7/1981 Rydell ..... 271/189 X 4,822,024 4/1989 Takahashi ..... 271/306 X 4,958,827 9/1990 Kaneko ..... 271/176

5,101,241 3/1992 Watanabe ..... 271/200 X

*Primary Examiner*—William E. Terrell

*Assistant Examiner*—Tamara Kelly

*Attorney, Agent, or Firm*—Cushman, Darby & Cushman

[57] ABSTRACT

The device (11) conveys the sheets (14) output from a laser printer (10) for deposition on a stack (12). For matching to the growing height of the stack (12), at least one conveying roller (28) defining an outlet (37) is arranged on a height-adjustable carriage (21). A feeler lever (26) senses the respective height of the stack (12) and effects an automatic tracking of the carriage (21). By means of the device (11), the achievable stack height can be multiplied with respect to the standard height.

10 Claims, 4 Drawing Sheets

Figure 1:
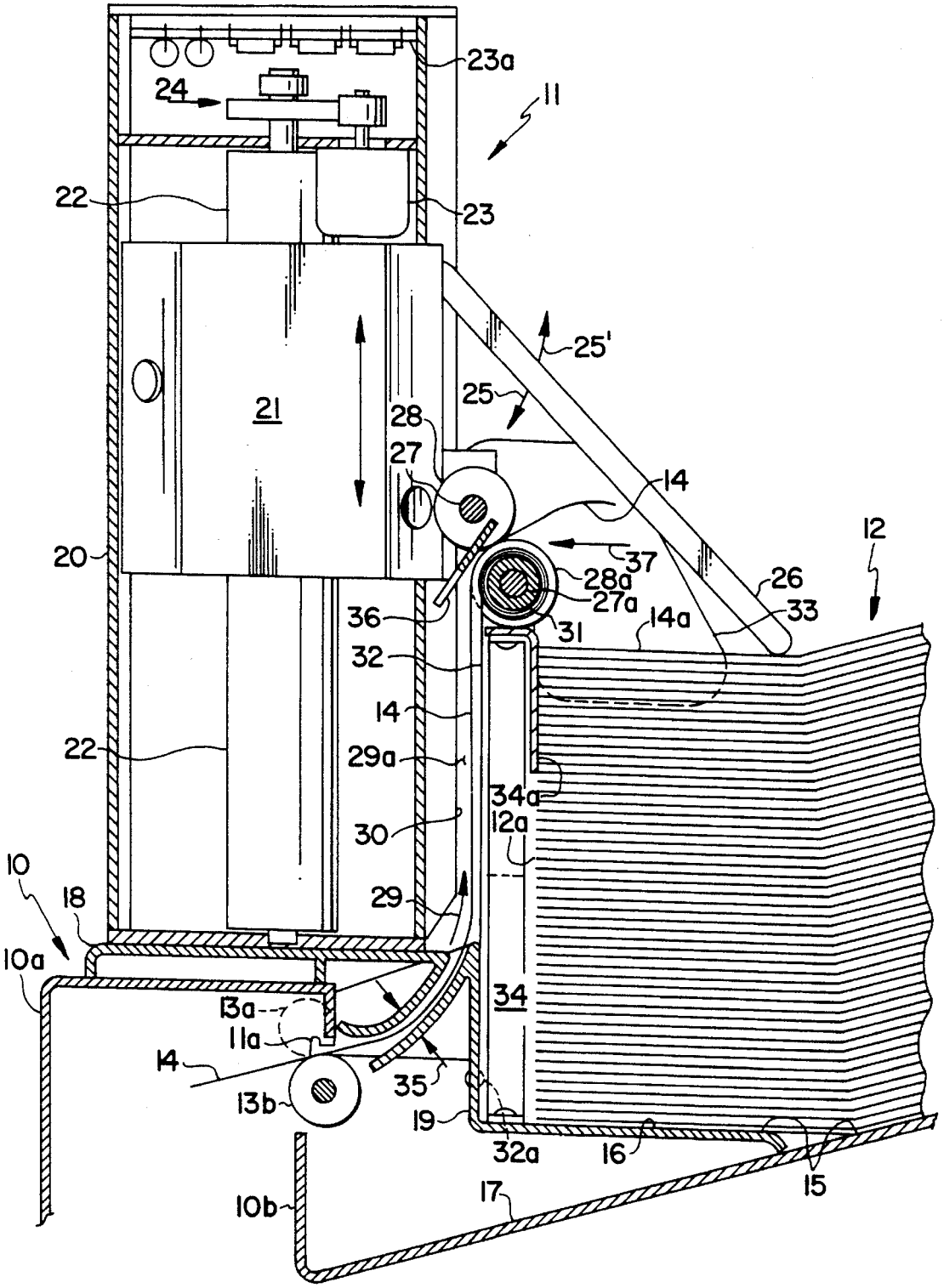

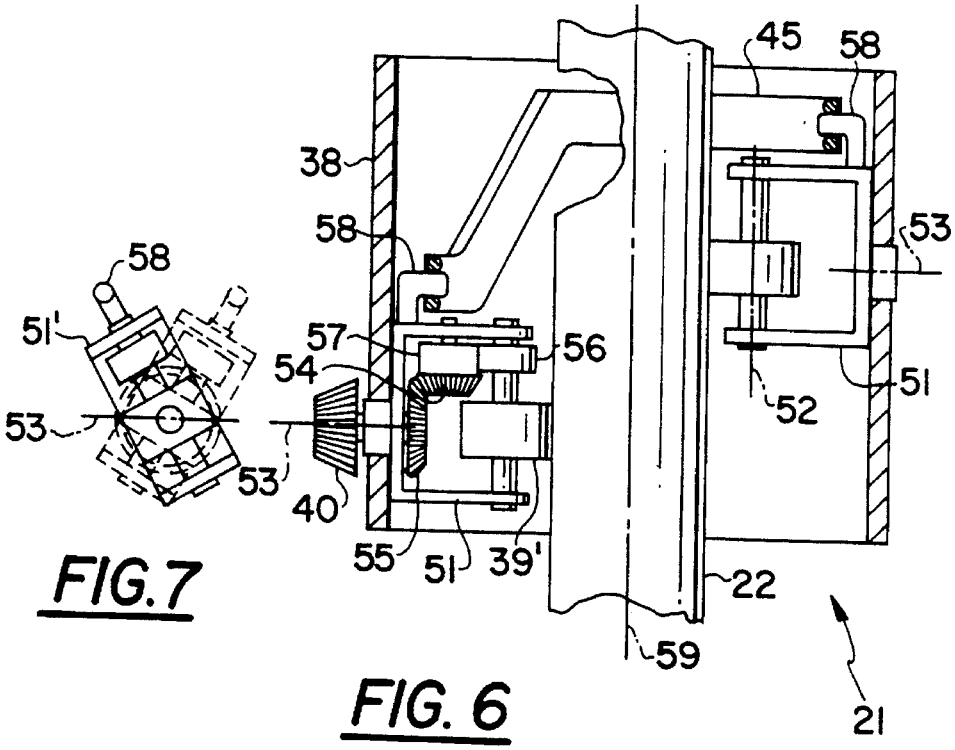
FIG. 7
FIG. 6
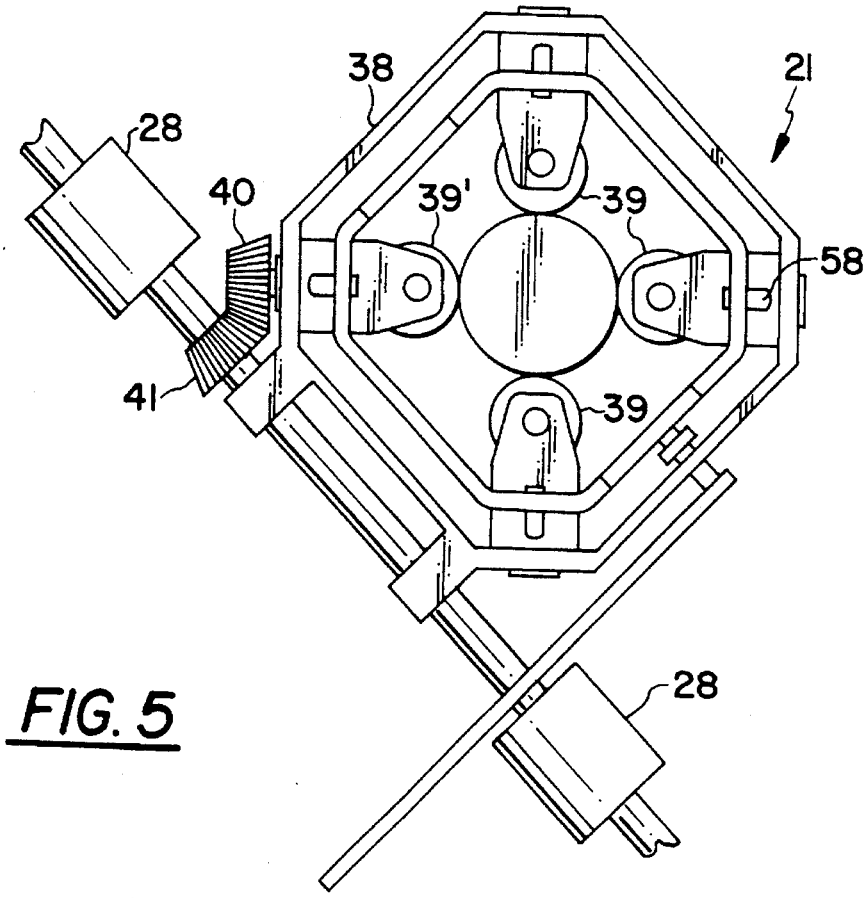
FIG. 5

DEVICE FOR DEPOSITING AND/OR STACKING SHEET-LIKE RECORDING SUBSTRATES

The invention relates to a device of the type mentioned in the preamble of claim 1.

Such a device, built onto or into a printing device, accepts the individual recording substrates, as a rule printed sheets, conveyed out of a dispensing opening of the printing device, in order to convey them further and to form a stack therefrom.

The designation printing devices comprises all devices which produce printed products in the form of individual sheets, for example the printers commonly connected to PCs, copying devices, fax devices and, if applicable, also offset printing machines. However, the invention is particularly suitable for efficient laser printers and copiers and for combined printing devices, such as for example a printer/copier/fax device.

The printing devices common in office operations are, as a rule, provided for an output of up to 200 sheets. This generally corresponds to the accommodation capacity of an individual supply magazine. If, however, a printing device is equipped with a plurality of or with larger supply magazines or is connected to such, the output in one operation can amount to a multiple of the accommodation capacity provided of the deposit surface of the printing device. To accommodate such a quantity, a correspondingly large-dimensioned stack region is necessary. However, this presupposes a relative movement between the floor of the stack and the sheet-feed plane, in order to ensure trouble-free deposition of the sheets on the stack with increasing stack height. Without such a relative movement there would result, at the beginning of the formation of the stack, too great a fall height and this would prevent trouble-free stack formation, especially when the sheets leave the printing device curved.

For this purpose, in the case of a sheet-feed plane of constant height, it is known to move downward a table serving as stacking surface as the stack height increases. In the case of another known device, the stack is raised for each fed sheet, in order to push the respective sheet underneath. In both cases it is necessary to move the relatively heavy stack by means of a drivable device, for which a heavy construction and a corresponding energy demand are necessary. Resilient stack deposits are specifically also known which move downwards as the weight increases. However, these are imprecise in maintaining a height optimal for depositing.

It is therefore the object of the invention to provide a device of the type mentioned at the beginning with which a relatively large stack height can be achieved without needing to move the stack with a drive device.

The solution of the objective set is achieved, according to the invention, by the features specified in the preamble of claim 1.

The solution according to the invention is especially suitable for a stack floor not connected to a drive device, for example for the deposit surface already present in a printing device or also for a deposit surface of fixed position on the device according to the invention. By means of the automatic matching of the sheet-feed plane to the upper end of the stack, a considerably greater stack height can be achieved, for example of two thousand sheets and more.

By virtue of the capability of using the deposit surface of a printing device already present as stack floor for the significantly greater stack height, the device according to the invention can be particularly simply configured. In addition, in such a solution, space is saved, since no additional positioning surface is necessary for the device according to the invention, if this is fitted onto a printing device and, if necessary, fastened thereto.

A further advantage is the omission of a lifting device dimensioned for the heavy stack, which results in the saving of material, space and energy.

Preferred exemplary embodiments of the invention are described in the dependent claims.

Figure 2:
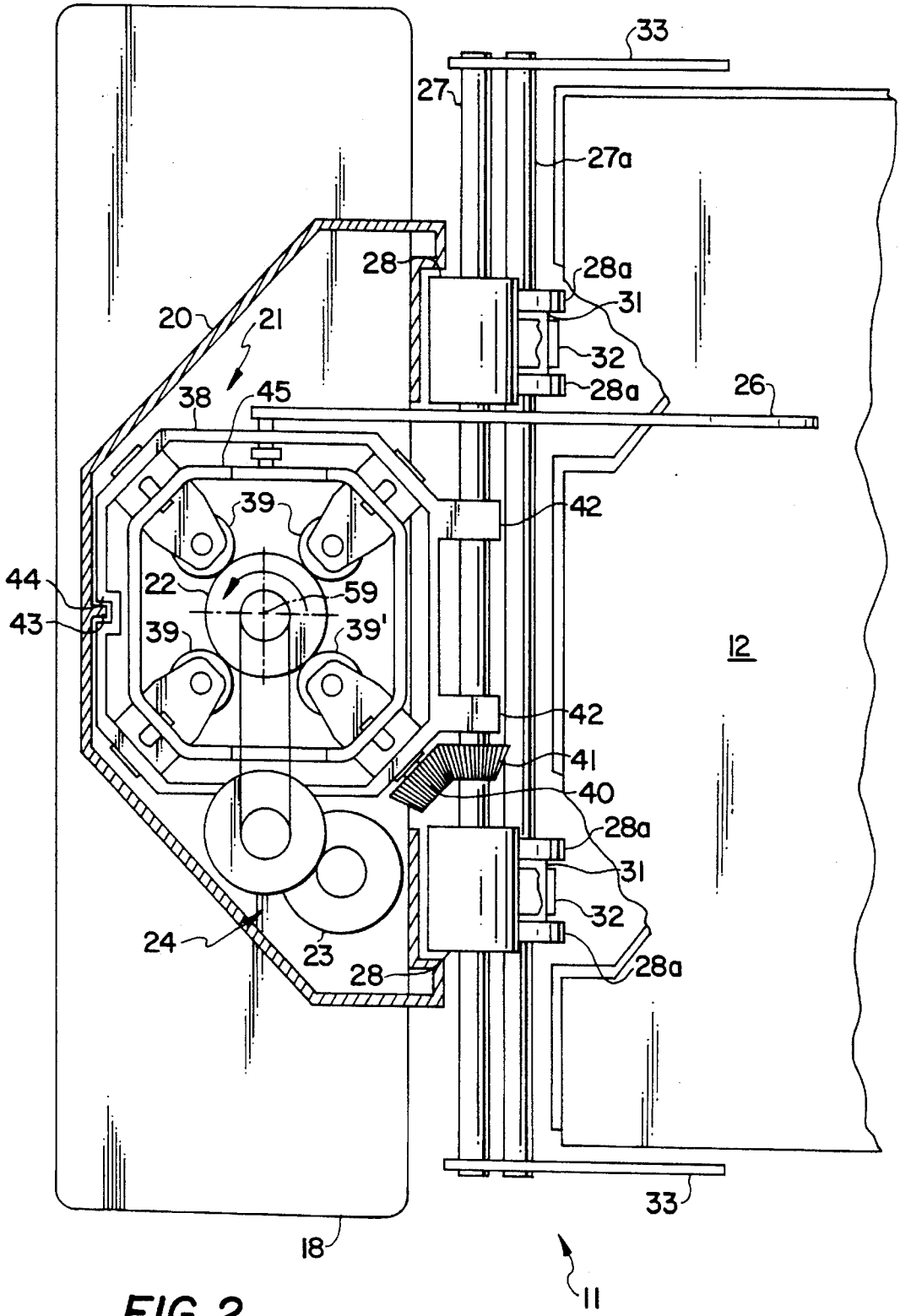
Figure 4:
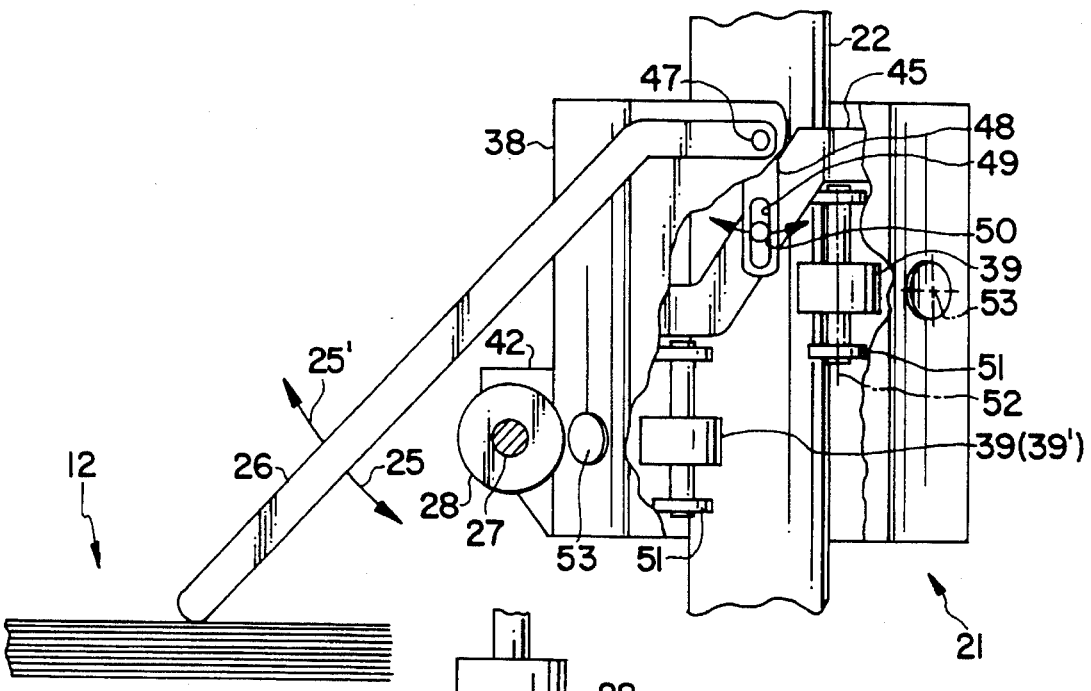
Figure 3:
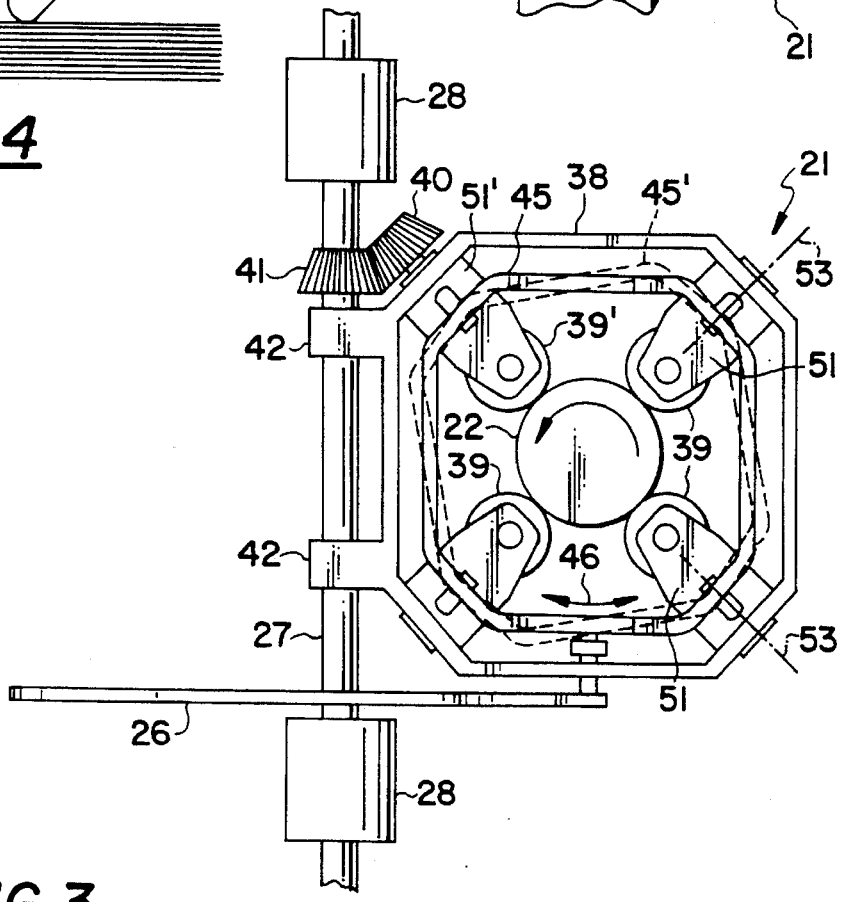

One exemplary embodiment of the invention is explained in more detail using the drawings, in which:

FIG. 1 shows a device, fitted onto a laser printer, for the stacking of printed sheets, with a carriage adjusting itself in the vertical direction, partially in a longitudinal section seen from the side, FIG. 2 shows a top view of the device according to FIG. 1, partially in section, FIG. 3 shows a top view of the carriage with conveying rollers arranged thereupon, shown offset by 180° with respect to FIG. 2, FIG. 4 shows the carriage according to FIG. 3 in a side view, partially in section, FIG. 5 shows the carriage as in FIG. 3, but shown rotated by 45°, FIG. 6 shows the carriage according to FIG. 5, partially in longitudinal section and FIG. 7 shows the pivoting capability of a carrying roller.

FIG. 1 shows a stacking device 11 fitted onto a laser printer 10 and secured thereto by means of a hook element 11*a*. It serves for forming a stack 12 whose height can exceed by many times the height of, for example, 200 sheets commonly known as maximum height.

The laser printer. 10 has parts 10*a*, 10*b* of an upper covering, shown in section, and at least one conveying roller 13*a*, 13*b*, by means of which in each case a printed sheet 14 is conveyed out, which is accepted by the stacking device 11 and is deposited onto the stacked sheets 14*a* on the stack 12.

The stack 12 rests on a fixed stack floor 15, which is partly formed by a surface 16 of the stacking device 11 and partly by a deposit surface 17 of the laser printer 10.

The stack floor 15, however, can also be formed completely either-by a part of the stacking device 11 or by a part of the laser printer 10. In the present exemplary embodiment, the deposit surface 17 of the laser printer 10 is the standard deposit surface in the case of a stacking device not being present.

The stacking device 11 has profiled base parts 18, 19, shown in section and matched to the laser printer 10. Constructed thereupon, there stands a likewise profiled chute element 20, shown in section, in which a carriage 21 is guided in the manner of an elevator. An upright drive shaft 22, which can be continuously driven via a transmission 24 by means of an electric motor 23, for example a DC motor with a clock generator, serves as a drive for the carriage 21. A circuit arrangement 23*a* on a printed circuit board is used for controlling the motor 23. The connection of the drive shaft 22 to the carriage 21 is explained using the subsequent figures.

Supported on the carriage 21 is a freely-moving feeling lever 26 which can pivot in the direction of the double arrow 25, with which the respective height of the stack 12 is sensed. If the height increases, the carriage 21 then moves upward to an approximately equal extent. If the stack is removed, the carriage 21 then moves downward.

In addition, two horizontal shafts 27, 27a are arranged on the carriage 21, of which shaft 27 is connected to the drive shaft 22 via transmission elements not visible in FIG. 1 so as to be drivable. Mutually spaced conveyor rollers 28 are arranged in a rotationally fixed manner on the shaft 27. Nip rollers 28*a* are arranged in a rotationally fixed manner on the shaft 27*a*, between which nip rollers and the conveyor rollers 28 a clamping gap is formed. In this clamping gap, the sheet 14 delivered through the conveyor roller(s) 13*a*, 13*b* of the laser printer 10 and deflected upward into the conveying path 29 is conveyed onto the stack 12. The conveying path 29 is defined by a conveying channel 29*a*.

The conveying channel 29*a* is bounded on its one broad side by, the surface 30 of the chute element 20 facing the stack 12 and, on the other broad side, by at least one steel strip 32 which can be rolled up automatically on a roller 31. The end of the steel strip 32 is connected to the base part 19 by means of a rivet 32*a*, while its roller 31 is arranged on the shaft 27*a*. If the carriage 21 is driven upward, the steel strip is unrolled from its roller 31, in order to bound the conveying channel 29*a* in a secure manner at each position of the carriage 21.

For the lateral guidance of the respective sheet to be deposited on the stack 12, lateral guiding elements 33 likewise arranged on the carriage 21 on both sides of the stack 12 are used. These guiding elements 33, running with the carriage 21, ensure trouble-free stack formation by means of lateral guidance of the fed sheets at the upper stack end. The lower part of the stack 12 needs no lateral guidance, since it is inherently sufficiently stable because of its own weight.

The feeler lever 26 resting continuously on the stack 12 is light, so that it does not hinder the feeding of the sheets.

On the outer end of the stack 12 remote from the stacking device 11, a stop, not shown, can be present, fastened on the carriage 21. On the inner end 12*a* of the stack 12 facing the stacking device 11, a lattice grating 34 pulled up with the carriage 21 serves, with an angle 34*a* arranged on its upper end, as an end stop for the upper end of the stack 12.

The arrows 35 at the entry into the conveying channel 29*a* designate a light barrier whose beam is interrupted by the sheet 14 fed from the printer 10. Starting the stacking device 11 is thus initiated by switching on the drive 23, 24 for the drive shaft 22. After a predetermined time, after which no further sheet is fed, the drive is switched off again. An automatic, energy-saving operation of the stacking device 11 is thus ensured. In addition, the unavoidable generation of noise is restricted to a minimum.

Before the outlet of the conveying channel 29*a* is a deflection element 36 fastened on the carriage 21 by means not shown, to ensure that the sheet 14 conveyed upward through the conveying channel 29*a* is guided through the conveying rollers 28 into an at least approximately horizontally directed outlet 37, in order to ensure a permissible deposition on the stack 12, the sheet 14 having to overcome the nip rollers 28*a*. For reliable further conveying, the latter can be populated around their periphery if required with knob-like projections (not shown).

The deflection element 36 fastened on the carriage 21 carries one of the two lateral guiding elements 33 on each of its two outer ends. The two shafts 27, 27*a* are supported in said guiding elements.

In FIG. 2, most of the elements already explained with reference to FIG. 1 can be recognized again using the same reference numbers. In addition, it can be seen therefrom that the drive shaft 22 extends through the carriage 21. The carriage 21 has a housing 38 which is octagonal in cross section, in which are mounted four carrying rollers 39, 39' which are supported on the drive shaft 22 and hence carry the carriage 21.

On one carrying roller 39' the rotational movement is transmitted by means of transmission elements hidden in FIG. 2, including two bevel wheels, to a third bevel wheel 40 arranged outside the housing 38. The latter bevel wheel further transmits the rotational movement to a fourth bevel wheel 41 connected in a rotationally fixed manner to the shaft 27 in order to drive the conveying rollers 28 seated on this shaft.

In addition, it can be seen that each conveying roller 28 has allocated to it two nip rollers 28*a* and that the rollers 31 for the two steel strips 32 are respectively located-between two nip rollers 28*a*.

The shaft 27, in addition to the bearings in the lateral guiding elements 33, is mounted in two journals 42 arranged on the housing 38. As a consequence it can be seen that the previously listed parts are moved together with the carriage 21 in the event of a lifting movement (still to be described) of the said carriage 21.

On the rear side of the chute element 20, there is a vertical web 43 directed inward, which engages in a groove 44 arranged on the housing 38 of the carriage 21 as a means of securing the carriage 21 against rotation but leaving the latter sufficient clearance for the lifting movement.

Inside the housing 38 of the carriage 21, a displacing ring 45 is arranged so as to be rotatable by means of the feeler lever 26 about the axis 59 of the drive shaft 22. This displacing ring is used for pivoting the carrying rollers 39, 39'.

In FIG. 3, the displacing ring 45 is additionally shown by dotted lines in a displaced position 45'. A double arrow 46 designates the displaceability.

It can be seen from FIG. 4 that the two forward carrying rollers 39, 39' facing the magazine 12 are arranged deeper than the two rearward carrying rollers 39. This results in better supporting of the carriage 21 on the drive shaft 22 than if all four carrying rollers were to be located at the same height, since the carriage 21 is loaded on one side, on the side facing the magazine 12, by the conveying rollers 28 and the associated transmission elements 40, 41. As already mentioned, the carriage 21 is carried by the four carrying rollers 39, 39' engaging on the drive shaft 22. It is possible to support or to compensate the weight of the carriage 21 by means of a relieving spring, not shown, clamped or supported on the chute element 20. This can especially also therefore be necessary, since the carriage 21 is additionally loaded by the withdrawable steel strip 32.

If the feeler lever 26, mounted on a pivot axis 47, is lifted up by an increase of the stack 12 in the direction of the arrow 25', it displaces by means of an intermediate lever 48 the displacing ring 45 according to FIG. 3 in the clockwise direction, that is to say toward the dotted representation 45'. The dotted representation 45' is assumed, in contrast, when the feeler lever 26 is lowered by removal of the stack 12.

In accordance with FIG. 4, the intermediate lever 48 having a slot 49 engages with a guiding peg 50 arranged in the displacing ring 45, with the result that the pivoting movement of the feeler lever 26 is transmitted into a rotational movement of the displacing ring 45.

Each of the four carrying rollers 39, 39' is supported in a u-shaped mounting 51, 51' so as to be rotatable about its axis of rotation 52. The mountings 51, 51' are, for their part, supported in the housing 38 of the carriage 21, in each case so as to be able to pivot about a horizontally arranged pivot axis 53, and are arranged offset from each other by an angle of 90°.

FIG. 5 corresponds essentially to FIG. 3 but is shown offset thereto by an angle of 45°. FIG. 6, opened up by an angle of 90° to FIG. 5, is thereby more comprehensible.

In FIG. 6, the transmission elements hidden in the previous figures but already mentioned, including the first and second bevel wheel 54, 55, are shown. These transmit the rotational movement of the carrying roller 39' via further transmission elements 56, 57 to the third bevel wheel 40 which is used to drive the conveying rollers 28 in accordance with FIGS. 2, 3 and 5.

For pivoting the carrying rollers 39, 39' about the pivot axes 53, the displacing ring 45 engages in the u-shaped mountings 51, 51' via dogs 58. Hence, a displacing movement of the feeler lever 26 is simultaneously transmitted to all four carrying rollers 39, 39', with the result that the latter are pivoted in each case by the same angle to one another.

By means of the pivoting it is effected that the carriage 21, when the drive shaft 22 is in operation, either stays at a constant height or is moved upward or downward as a function of the position of the feeler lever 26. Irrespective of the pivoting it is ensured that the conveying rollers 28 are driven via the transmission elements 39', 56, 57, 54, 55, 40, 41 by the drive shaft 22.

FIG. 7 shows that the pivot axis 53 of the mountings 51, 51' coincides with the axis of rotation of the bevel wheels 40, 55.

It follows from the previous explanations that the carriage 21 assumes, when the drive shaft 22 is in operation, a stable position at a constant height as long as the axes of rotation 52 of the carrying rollers 39, 39' are parallel to the axis 59 of the drive shaft 22.

If the height of the stack 12 is altered by feeding or removing sheets 14*a*, the feeler lever 26 effects an upward or downward movement of the carriage 21. Thus, the feed plane or the at least approximately horizontally directed outlet 37 of the sheets 14 is also simultaneously moved. This movement is relative to the fixed stack floor 15 (FIG. 1). As a function of the height of the sheet outlet 37, the length of the conveying channel 29*a* is altered. As already mentioned, the latter is bounded in the direction of the stack 12 by at least one withdrawable steel strip 32. It is thereby ensured that this bounding is automatically matched to the length of the conveying channel 29*a*, with the result that the respectively conveyed sheet 14 is guided reliably in the conveying channel 29*a*.

The conveying channel 29*a* of the device 11 begins at the outlet of the laser printer 10, defined by the conveying rollers 13*a*, 13*b*. It ends at the outlet 37 at which the sheets are transferred after the conveying rollers 28 of the device 11 into an at least approximately horizontal position for depositing on the stack 12.

It can be seen from this that the conveying channel 29*a* in the present exemplary embodiment must be shorter than a sheet length in order to guarantee that the sheets delivered by the laser printer 10 can be reliably seized by the conveying rollers 28. If the conveying channel 29*a* is to be longer than one sheet length, at least one additional conveying roller is necessary.

Although the carriage 21 in the exemplary embodiment has four carrying rollers 39, 39' engaging on the drive shaft 22, which center the said carriage 21 about the drive shaft 22, a construction according to the same principle having a different number of rollers engaging on the drive shaft is also possible. In this case it can then also be necessary to support or to center the carriage by means of other elements, for example on rails by means of rollers running in the direction of movement of the carriage. In this case, in the same manner as in the previous exemplary embodiment, the rotational movement for conveying rollers can be derived from the drive shaft.

More than four carrying rollers can also be used, however, for example in order to place one thereof into the center line of the stack surface for the symmetrical support of the elements loading the carriage 21.

In order to ensure a permissible adhesion between the drive shaft 22 and the carrying rollers 39, 39' it is necessary to use materials of different hardness at least for those surfaces of these parts which are in frictional contact with one another.

The speed of the drive 23 can be changed by means of its circuit arrangement 23*a* in order to match the conveying speed of the conveying rollers 28 to that 13*a*, 13*b* of the printer 11.

The transmission of the rotational movement from the drive shaft 22 to the conveying rollers 28 is ensured by the arrangement of the transmission elements 56, 57, 54, 55, 40, 41 even when the carrying roller 39*a* is pivoted out of its neutral position for adjusting the height of the carriage 21.

As follows from the previous embodiments, the device according to the invention is advantageous from many points of view. It makes possible the use of the already available stack surface of a printing device in order to be able to deposit thereon a multiple of the otherwise usual number of recording substrates, it requires no additional positioning surface, needs only one single motor for the height adjustment and the drive of the conveying rollers 28, the transmission of the drive force for the two tasks being carried out via a single shaft 22, and it effects the control or automatic regulation of the height adjustment in the most simple way exclusively with mechanical means.

The height adjustment carried out as a function of the position of the feeler lever 26 works completely continuously, and is comparable with a continuous proportional control. The larger the deviation of the stack height from the assigned position of the height-adjustable outlet 37, for example in the case of removal of the stack 12, the greater is the pivoting of the feeler lever 26 and the more rapidly is the adjustment carried out. As soon as the height-adjustable outlet 37 approaches its target, the adjustment speed becomes smaller until the neutral position is reached as a balanced condition.

A further notable feature of the invention is that an adjustment in both directions is possible with a constant direction of rotation of the driving shaft 22 and that the reversal is carried out gently.

The guiding of the stack 12 at its upper edge is sufficient for stack formation, the guiding elements 33, 34*a* serving therefor and the outer stop, not shown, running simultaneously with the carriage 21.

We claim:

1. A device for at least one of depositing and stacking sheet-like recording substrates for a printing device intended for at least one of printing, copying and transmitting faxes, having a conveying path to be arranged at an outlet of the printing device, for further conveying the recording substrates to a deposit, wherein the conveying path has conveying means and an outlet for the recording substrates that can be adjusted in height relative to a stack floor of the deposit, the height-adjustable outlet being arranged on a vertically moveable carriage that can be controlled for automatic matching of the height-adjustable outlet to an upper end of a stack of recording substrates lying on the stack floor by means of a sensor specified for sensing the upper stack end, wherein a drive shaft, which can be driven continuously, extends parallel to the direction of movement of the carriage, at least approximately over a length corresponding to a maximum length of the conveying path, wherein the carriage has at least one carrying roller which is supported continuously on the drive shaft and can be driven thereby and can be pivoted about a pivot axis running at right angles to a longitudinal axis of the drive shaft, an axis of said at least one carry roller runs parallel to the axis of the drive shaft in neutral position, and wherein the sensor is connected to means for pivoting the carrying roller, about its pivot axis.

2. The device as claimed in claim 1, wherein there are a plurality of said carrying rollers and wherein the carriage has a housing surrounding the drive shaft, in which housing said plurality of carrying rollers, which can be driven by the drive shaft, are arranged distributed around the drive shaft and are supported continuously thereon, and wherein the sensor, designed as a feeler leaver, engages with transmission means on all the carrying rollers to achieve a uniform displacement about their respective pivot axes.

3. The device as claimed in claim 2, wherein the transmission means have a displacing ring surrounding the drive shaft, said ring being coupled to the feeler lever in such a way that it executes a rotary movement about the drive shaft in the event of the feeler level pivoting about its pivot axis and, in so doing, engages in mountings of the carrying rollers, in order to pivot the latter.

4. The device as claimed in claim 2 or 3, wherein there are four carrying rollers, offset from each other at an angle of 90° around the axis of the drive shaft and aligned diagonally with respect to a longitudinal axis of the stacking surface and wherein two said four carrying rollers define forward carrying rollers that are arranged in a plane below a plane of the two other carrying rollers.

5. The device as claimed in claim 4, wherein the conveying means have at least one conveying roller which can be adjusted for height together with the carriage, wherein one of said forward carrying rollers, is coupled to the conveying roller via transmission elements as a drive-transmission element for the conveying roller.

6. The device as claimed in claim 1, wherein a conveying channel defining the conveying path is bounded on one side thereof by a surface of a chute element serving as a guide for the carriage and, on an other side thereof, by at least one steel strip which can be pulled off from a roller and rolls itself up automatically.

7. The device as claimed in claim 1, wherein the stacking floor is fixed.

8. The device as claimed in claim 1, wherein guiding elements running with the carriage for forming the upper end of the stack are provided and connected to each other so as to be disposed on at least three sides of the stack to be formed.

9. A device for at least one of depositing and stacking sheet-like recording substrates for a printing device intended for printing, copying or transmitting faxes, having a conveying path to be arranged at the outlet of the printing device, for further conveying the recording substrates to a deposit, wherein the conveying path has conveying means and an outlet for the recording substrates that can be adjusted in height relative to a stack floor of the deposit, wherein a conveying channel defining the conveying path is bounded on one side thereof by a surface of a chute element serving as a guide for the carriage and, on an other side thereof, by at least one steel strip which can be pulled off from a roller and rolls itself up automatically.

10. A device for at least one of depositing and stacking sheet-like recording substrates for a printing device intended for at least one of printing, copying and transmitting faxes, having a conveying path to be arranged at an outlet of the printing device, for further conveying the recording substrates to a deposit, wherein the conveying path has conveying means and an outlet for the recording substrates that can be adjusted in height relative to a stack floor of the deposit, the height-adjustable outlet being arranged on a vertically moveable carriage that can be controlled for automatic matching of the height-adjustable outlet to an upper end of a stack of recording substrates lying on the stack floor by means of a sensor specified for sensing the upper stack end, wherein guiding elements running with the carriage for forming the upper end of the stack are provided and connected to each other so as to be disposed on at least three sides of the stack to be formed.

* * * * *